US009868314B2

(12) United States Patent
Yagi et al.

(10) Patent No.: US 9,868,314 B2
(45) Date of Patent: Jan. 16, 2018

(54) DECOLORING METHOD AND DECOLORING DEVICE

(71) Applicants: KABUSHIKI KAISHA TOSHIBA, Tokyo (JP); TOSHIBA TEC KABUSHIKI KAISHA, Tokyo (JP)

(72) Inventors: Norifumi Yagi, Tokyo (JP); Takao Ishida, Kanagawa (JP); Kanya Hiroi, Kanagawa (JP); Mamoru Nomura, Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 261 days.

(21) Appl. No.: 14/978,393

(22) Filed: Dec. 22, 2015

(65) Prior Publication Data

US 2016/0107469 A1 Apr. 21, 2016

Related U.S. Application Data

(63) Continuation of application No. 13/952,367, filed on Jul. 26, 2013, now Pat. No. 9,248,661.

(51) Int. Cl.

| | |
|---|---|
| ***B41J 2/32*** | (2006.01) |
| ***B41M 7/00*** | (2006.01) |
| ***B65H 31/24*** | (2006.01) |
| ***B65H 29/62*** | (2006.01) |
| ***B65H 43/04*** | (2006.01) |

(52) U.S. Cl.

CPC ..... *B41M 7/0009* (2013.01); *B41J 2/32* (2013.01); *B41M 7/00* (2013.01); *B41M 7/009* (2013.01); *B65H 29/62* (2013.01); *B65H 31/24* (2013.01); *B65H 43/04* (2013.01); *B41J 2202/37* (2013.01); *B65H 2301/314* (2013.01); *B65H 2301/33312* (2013.01); *B65H 2301/5111* (2013.01); *B65H 2404/166* (2013.01); *B65H 2408/111* (2013.01); *B65H 2511/414* (2013.01); *B65H 2557/23* (2013.01)

(58) Field of Classification Search

CPC ..... B41M 7/0009; B41M 7/00; B41M 7/009; B41J 2/32

See application file for complete search history.

(56) References Cited

U.S. PATENT DOCUMENTS

2011/0222084 A1 9/2011 Iguchi et al.
2012/0257264 A1* 10/2012 Megawa ..... B41M 7/0009 358/505
2012/0306144 A1 12/2012 Taki et al.
(Continued)

*Primary Examiner* — Jason Uhlenhake
(74) *Attorney, Agent, or Firm* — Patterson & Sheridan, LLP

(57) ABSTRACT

A decoloring device according to an embodiment includes a decoloring unit that erases a first image formed with erasable colorant on a first side of a sheet and a second image formed with erasable colorant on a second side of the sheet. A reading unit reads the first and second sides of the sheet and determines whether the first side and the second side are reusable. A single-side reusable paper tray stacks the sheet if the reading unit determines that only one of the first and second sides is reusable. A marking unit adds a mark to the one of the first and second sides that is determined to be not reusable when only one of the first and second sides is determined to be reusable.

20 Claims, 4 Drawing Sheets

(56) References Cited

U.S. PATENT DOCUMENTS

| | | | | |
|---|---|---|---|---|
| 2013/0003134 | A1 | 1/2013 | Hazu et al. | |
| 2013/0015623 | A1 | 1/2013 | Iguchi et al. | |
| 2013/0063793 | A1* | 3/2013 | Suzuki | G03G 21/00 358/498 |

* cited by examiner

DECOLORING METHOD AND DECOLORING DEVICE

CROSS-REFERENCE TO RELATED APPLICATION

This application is a continuation of U.S. patent application Ser. No. 13/952,367, filed on Jul. 26, 2013, the entire contents of which are incorporated herein by reference.

FIELD

Embodiments described herein relate generally to a decolorization method to erase printed text and images and a device employing this technology.

BACKGROUND

Conventionally, decoloring devices have a decoloring function of erasing printed information, such as text and images. Such a device scans and stores the text and images formed on a sheet in an electronic data format, and the text and images formed on the sheet are erased, based on the stored electronic data. The sheets that have been subject to erasing are sorted into either a tray for reusable paper or a tray for paper that has been determined to be reused.

However, problem is that, when one side of a sheet with images printed on both sides thereof cannot be successfully subject to erasing, there is no consistency in whether the reusable or non-reusable side is sorted and stacked facing up or down, which is annoying for users.

DETAILED DESCRIPTION

Figure 1:
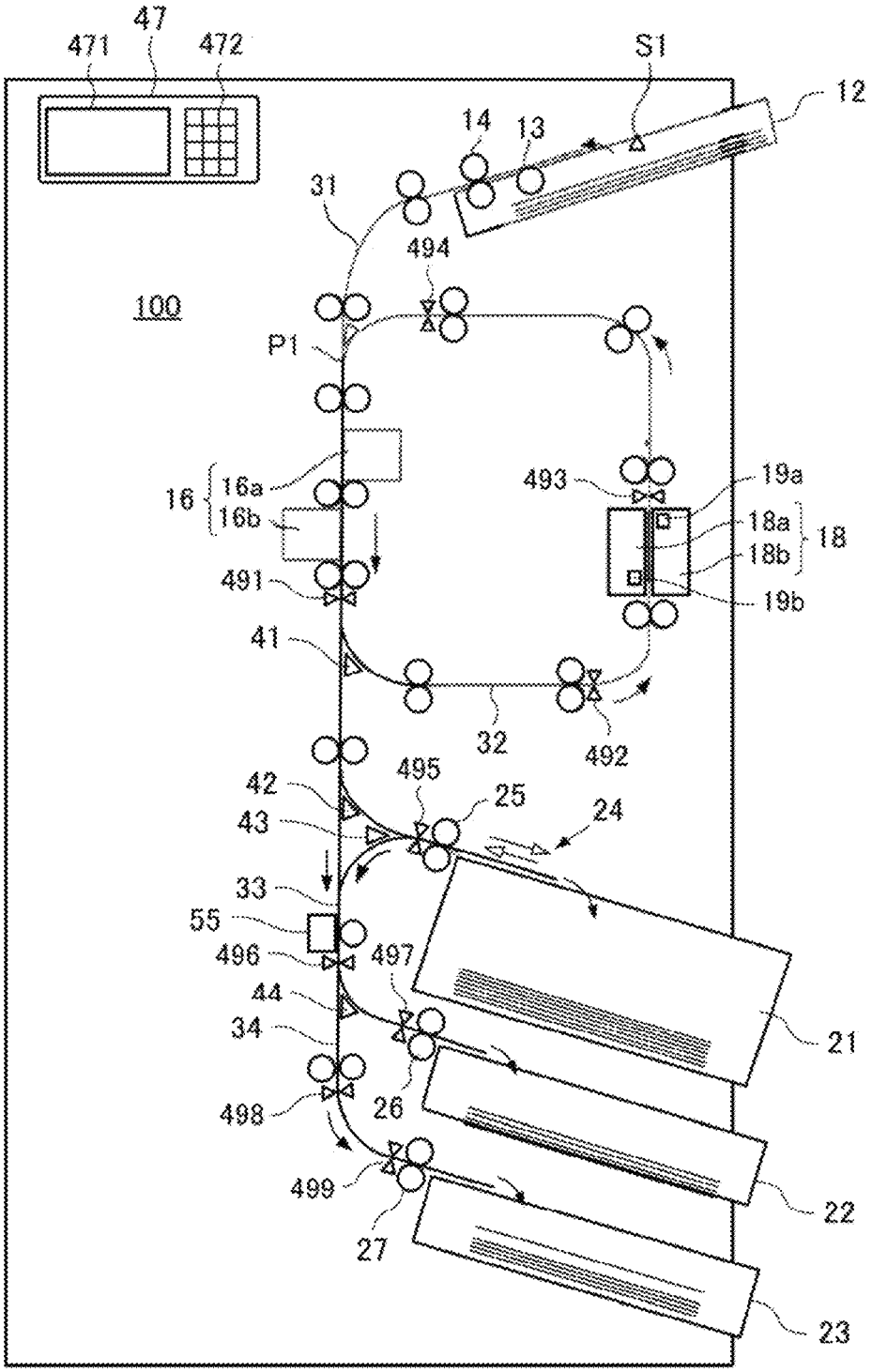
FIG. 1 is a block diagram showing a schematic system according to a first embodiment of the decoloring device.

A decoloring device according to an embodiment comprises a decoloring unit configured to erase a first image formed with erasable colorant on a first side of a sheet and a second image formed with erasable colorant on a second side of the sheet, and a reading unit configured to read the first and second sides of the sheet and determine whether the first side and the second side are reusable. The decoloring device further comprises a single-side reusable paper tray configured to stack the sheet if the reading unit determines that only one of the first and second sides is reusable, and a reversing unit configured to reverse the sheet and discharge the sheet to the single-side reusable paper tray so that the one of the first and second side determined to be reusable is stacked on the single-side reusable paper tray in a predetermined orientation.

Below, the embodiments are explained in detail, with referring to the drawings. In the present disclosure, "decolor" and related derivative words are used interchangeably with "erase" and related derivative words.

First Embodiment

FIG. 1 is a block diagram showing a schematic system of the decoloring device according to the first embodiment.

The decoloring device 100, when used for a sheet on which images have been formed in an "erasable coloring material," such as an erasable toner or ink, performs a "decoloring process," which erases the colors of the images in the erasable coloring material. Erasable coloring materials include chemical compounds with a coloring property, color-developing agents, and decoloring agents. An example of a chemical compound with the coloring property is a leuco dye. An example of color-developing agents is phenols. The decoloring agents are materials that exhibit chemical attraction to chemical compounds with the coloring property when heated and do not have chemical attraction to color-developing agents. Erasable coloring materials develop colors as the result of contact with chemical compounds with the coloring property and color-developing agents and lose colors when heated above the decoloring temperature because the chemical bond between the chemical compounds with the coloring property and the color-developing agents is broken. Erasable coloring materials may be referred to as recording materials.

The decoloring device 100 comprises a paper-feeding tray 12; paper-feeding units 13, 14; a reading unit 16; a decoloring unit 18; a both-sided reusable paper tray 21; a one-side reusable paper tray 22; a rejected paper tray 23; discharge rollers 25, 26, and 27; a first conveying path 31; a second conveying path 32; a third conveying path 33; a fourth conveying path 34; a first flapper 41; a second flapper 42; a third flapper 43; a fourth flapper 44; and a control panel 47. The first through fourth flappers 41 through 44 can spin either clockwise or counterclockwise and control the conveying direction of sheets of paper.

The paper-feeding tray 12 stores the sheets to be reused. The paper-feeding tray 12 stores the sheets in various sizes, such as A4, A3, and B5. An example of the sheets stored in the paper-feeding tray 12 is a sheet on which images are formed in a recording material that is erasable by heat in predetermined temperature or higher. The paper-feeding unit includes a pick-up roller. The paper-feeding unit 14 includes a sheet-feeding roller and a separation roller arranged on the opposite side of the sheet-feeding roller. Together, the paper-feeding units 13 and 14 feed sheets from the paper-feeding tray 12 one by one to the first conveying path 31 inside of the decoloring device 100.

Additionally, the paper-feeding tray 12 includes a detection sensor S1 that detects the presence of sheets on the paper-feeding tray 12. The detection sensors S1 may be, for example, microsensors or microactuators. The first conveying path 31 forms the conveying path from the paper-feeding tray 12 towards the both-sided reusable paper tray 21. The first conveying path 31 conveys the sheets that have been fed to either the reading unit 16 or the both-sided reusable paper tray 21.

The reading unit 16 is arranged along the first conveying path 31 in the descending direction of the sheets conveyed from the paper-feeding tray 12. The reading unit 16, for example, contains a reading mechanism, such as a Charge Coupled Device (CCD) scanner or a Complementary Metal Oxide Semiconductor (CMOS) sensor. The reading unit 16 of this embodiment reads the images on both the first (front) and second (back) sides of each sheet being conveyed. Hence, the reading unit 16 comprises the first reading unit 16*a* and the second reading unit 16*b*, which are arranged along the first conveying path 31 on either side. The reading unit 16 is arranged so as to be able to read images on both sides of the sheets being conveyed.

The images read by the reading unit 16 are saved to the memory unit 52 described later (see FIG. 2). For example, by saving images on a sheet read by the reading unit 16 in an electronic data format to the memory unit 52 before the decoloring processes, the image data can be recovered in case the erased image data is needed. Also, the control unit 50 (see FIG. 2) later determines whether or not the sheet is erasable and whether or not the sheet is reusable, based on the images read by the reading unit 16.

The first flapper 41 as the switching unit is arranged past the reading unit 16. The first flapper 41 switches the conveying direction of sheets being conveyed. The first flapper 41 differentiates whether the sheets from the first conveying path 31 are to be directed to either the second conveying path 32 or the both-sided reusable paper tray 21. The second conveying path 32 diverges from the first conveying path 31 at the diverging point where the first flapper 41 is arranged. The second conveying path 32, which diverges from the diverging point, conveys the sheets to the decoloring unit 18.

Furthermore, the second conveying path 32 merges with the first conveying path 31 at the merging point P1 arranged on the conveying path before reaching the reading unit 16. Namely, the second conveying path 32 merges with the first conveying path 31 at the merging point P1 arranged between the paper-feeding tray 12 and the reading unit 16. Therefore, the second conveying path 32 can convey the sheets that have been conveyed from the reading unit 16 back to the reading unit 16 again via the decoloring unit 18. In other words, the sheets can be conveyed from the paper-feeding tray 13 or 14 to the reading unit 16, the decoloring unit 18, and then the reading unit 16 by controlling the first flapper 41.

The first conveying path 31 comprises the second flapper 42 arranged past the first flapper 41. The second flapper 42 directs the sheets that have been conveyed from the first flapper 41 to either the both-sided reusable paper tray 21 or the third conveying path 33. The third conveying path 33 conveys sheets to the one-sided reusable paper tray 22.

The third conveying path 33 comprises the fourth flapper 44 arranged past the second flapper 42. The fourth flapper 44 directs the sheets that have been conveyed from the second flapper 42 to either the one-sided reusable paper tray 22 or the fourth conveying path 34. The fourth conveying path 34 conveys sheets to the rejected paper tray 23.

The decoloring unit 18 erases the colors of the images on the sheets being conveyed. For example, the decoloring unit 18 erases the colors of the images formed on the sheets in the recording material by heating the sheets to a certain decoloring temperature upon contact with the sheets being conveyed. For example, the decoloring unit 18 of the decoloring device 100 comprises 2 decoloring units 18*a* and 18*b* for decoloring the first side and the second side of each sheet, respectively. The decoloring units 18*a* and 18*b* are arranged across the second conveying path 32 from each other.

The decoloring unit 18*a* contacts one side of the sheet and applies heat to the sheet. The decoloring unit 18*b* contacts the other side of the sheet and applies heat to the sheet. The decoloring unit 18 decolors images on both sides of the sheets being conveyed at one pass through the decoloring unit 18. The decoloring units 18*a* and 18*b* are the decoloring locations to heat sheets and erase the color. The decoloring unit 18 also comprises the temperature sensors 19*a* and 19*b*, which detect the temperature of the heating system of the decoloring units 18*a* and 18*b*, respectively. The temperature sensors 19*a* and 19*b* may be a direct contact type or indirect contact type.

The control panel 47 arranged on the upper part of the body of the decoloring device 100 comprises the touch screen display unit 471 and the operation keys 472. The operation keys 472, for example, comprise a numeric keypad, the stop key, and the start key. The user controls the operating functions of the decoloring device 100, such as initiating decoloring and reading images on sheets to be erased, via the control panel 47. The display unit 471 displays the settings information, the operation status, the log-in information, or messages to the user of the decoloring device 100.

The control panel 47 is not necessarily limited to the configuration of being directly arranged on the body of the decoloring device 100. For example, the configuration wherein operations are performed from the control panel 47 arranged on an external device connected to the decoloring device 100 via a network may be allowed. Alternatively, the configuration wherein operations are performed from the control panel 47 that is independent from the body of the decoloring device 100 via a wired or wireless connection to the decoloring device 100 may also be allowed. The control panel 47 may take any form suitable for commanding processes and viewing information.

The discharge rollers 25, 26, and 27 each discharge sheets to the both-sided reusable paper tray 21, the one-sided reusable paper tray 22, and the rejected paper tray 23, which are arranged on the lower part of the body, respectively. For example, the both-sided reusable paper tray 21 stores the sheets that have been erased of the images and are reusable on both sides. The one-sided reusable paper tray 22 stores sheets that have been determined to be reusable on one side. The rejected paper tray 23 collects sheets that have been deemed non-reusable on either side.

The discharge roller 25 discharges sheets that are reusable on both sides to the both-sided reusable paper tray 21, where the sheets are stacked. Additionally, the discharge roller 25 comprises the sheet-reversing unit 24, which turns sheets over by switching back in such a way that the reusable side is sorted in a consistent direction on the one-sided reusable paper tray 22.

The sheets may be conveyed directly from the first conveying path 31 via the third conveying path 33 or may once be conveyed to the both-sided reusable paper tray 21 and then be turned over before reaching the one-sided reusable paper tray 22. Hence, the sheets are accumulated on the both-sided reusable paper tray 21 with the reusable side facing a predetermined direction, such as face-up.

Moreover, the types of sheets that are accepted to the both-sided reusable paper tray 21, the one-sided reusable paper tray 22, and the rejected paper tray 23 are interchangeable. The types of sheets that are to be sorted into each tray, namely, the conveying destination settings of sheets, for example, may be set by the control panel 47.

With the settings, the second flapper 42 directs the sheets being conveyed to either the both-sided reusable paper tray 21 or to the third conveying path 33 by switching the conveying paths. The fourth flapper 44 directs the sheets being conveyed to either the one-sided reusable paper tray 22 or to the fourth conveying path 34 by switching the conveying paths.

The decoloring device 100 comprises multiple sheet-detection sensors 491 through 499 that detect the sheets being conveyed on the first through fourth conveying paths 31 through 34. The sheet-detection sensors 491 through 499, for example, may be micro sensors or micro actuators. The sheet-detection sensors 491 through 499 are arranged at appropriate places on the first through fourth conveying paths 31 through 34.

Figure 2:
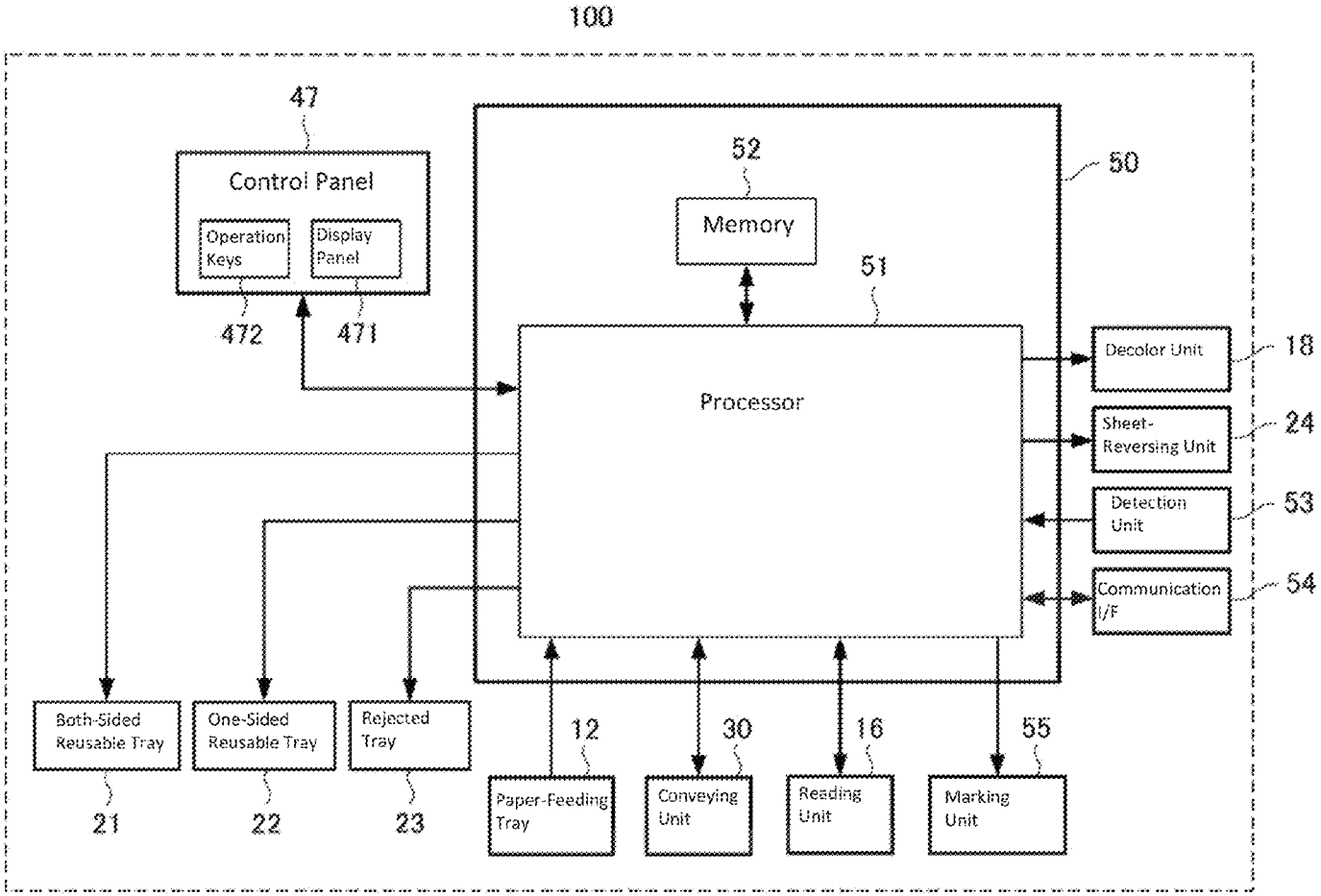
FIG. 2 is a block diagram showing the hardware configuration of the decoloring device according to the first embodiment.

FIG. 2 is the block diagram showing the hardware structure of the decoloring device 100. The decoloring device 100 comprises the control unit 50, a processor 51, the memory unit 52, a detection unit 53, a communication interface (communication I/F) 54, a conveying unit 30, the reading unit 16, the decoloring unit 18, and the control panel 47.

The control unit 50 controls the units inside of the device based on the signals from the detection unit 53. The detection unit 53 comprises the detection sensor S1, temperature sensors 19*a* and 19*b*, sheet-detection sensors 491 through 499, and other units as shown in FIG. 1.

The control unit 50 comprises the processor 51, which may include a Central Processing Unit (CPU) and/or a Micro Processing Unit (MPU), and the memory unit 52. The control unit 50 controls the reading unit 16, the decoloring unit 18, and the control panel 47. The memory unit 52, for example, may be a semiconductor memory and comprises the Read Only Memory (ROM), which stores various control programs, and the Random Access Memory (RAM), which provides the processor 51 with a temporary processing field. For example, the ROM stores a printing ratio of the used sheets as the threshold for the reusability, as well as a concentration threshold for determining whether or not the images have been erased. The RAM may temporarily save the images read by the reading unit 16. Each of the units of the decoloring device 100 is connected via a bus.

The decoloring device 100, for example, performs the reading process, the decoloring process, and the sorting process. The control unit 50 controls various units, such as the reading unit 16 and the decoloring unit 18, depending on the process settings.

The control unit 50 controls saving the images read by the reading unit 16 to the memory unit 52 during the reading process. The control unit 50 controls erasing the images with the decoloring unit 18 during the decoloring process.

The control unit 50 determines whether or not the sheets are reusable, based on the images read by the reading unit 16 during the sorting process. The control unit 50 determines whether or not any image is present on the sheets, based on the data read by the reading unit 16. When images are present on both sides, the sheet is deemed non-reusable. When images have successfully been erased from both sides after the decoloring process by the decoloring unit 18, the sheet is determines to be reusable on both sides. When an image remains only on one side, the sheet is determined to be reusable on one side.

The control unit 50 controls the units inside of the device, based on the signals from the detection unit 53. The detection unit 53 comprises the detection sensor S1, the temperature sensors 19*a* and 19*b*, and the sheet-detection sensors 491 through 499 as shown in FIG. 1. The detection unit 53 also comprises other parts not shown in the figure, such as the detection sensors that detect the number of sheets collected on the both-sided reusable paper tray 21, the one-sided reusable paper tray 22, and the rejected paper tray 23. The control unit 50 determines the presence of sheets on the paper-feeding tray 12, based on the signals from the detection sensor S1.

Additionally, the control unit 50 controls the temperature of the heating system of the decoloring units 18*a* and 18*b*, as well as detecting the temperature of the heating system of the decoloring units 18*a* and 18*b* by the temperature sensors 19*a* and 19*b*. The control unit 50 identifies the location of the sheets on the first through fourth conveying paths 31, 32, 33, and 34 by the sheet-detection sensors 491 through 499. For example, the control unit 50 uses the sheet-detection sensor 491 arranged immediately past the reading unit 16 to detect that sheets have passed through the reading unit 16.

The memory unit 52 stores the application programs and OS. The application programs comprise the programs that execute the functions of the decoloring device, such as the reading function of the reading unit 16 and the decoloring function of the decoloring unit. The application programs, furthermore, comprise the applications for web clients (web browsers) and other applications. The memory unit 52 saves the images read by the reading unit 16. Also, the memory unit 52 tracks the number of sheets processed by the decoloring device 100. For example, a hard disk drive or another magnetic storage device, an optical storage device, a semiconductor storage device, such as flash memory, or any combination of these devices may be used as the memory unit 52.

The communication I/F 54 is the interface that connects to external devices. The communication I/F 54 communicates with external devices on the network via Bluetooth (registered trademark), an infrared connection, an optical connection, or any suitable wired or wireless connection, such as IEEE802.15, IEEE802.11, IEEE802.3, and IEEE3304. The communication I/F 54, furthermore, may comprise USB ports which connect to terminals that meet the USB specification are to be connected, a parallel interface, etc.

The control unit 50 communicates with the multi-functional printer and other external devices via the communication I/F 54. For example, the memory unit 52 of the decoloring device 100 is not the only location where the images read by the reading unit 16 may be saved. For example, the control unit 50 may communicate with external devices, such as user terminals or multi-functional printers, or servers via the communication I/F 54 and save to the memory of the external devices. The image data saved in the external devices maybe retrieved from the operation unit or the user terminal of the multi-functional printer.

Furthermore, when the decoloring device 100 has log-in and log-out functions for user authentication purposes, the image data saved in the RAM or the memory unit 52 of the decoloring device 100 may be conveyed and saved to external devices when the decoloring device 100 logs out.

The conveying unit 30 comprises the multiple conveying rollers and conveying motors that power the conveying rollers arranged on the first conveying path 31, the second conveying path 32, the third conveying path 33, and the fourth conveying path 34. The control unit 50 controls the conveying speed of sheets by controlling the drive of the conveying motors of the conveying unit 30. The speed to convey sheets through the reading unit 16 for the images on the sheets to be read is referred to as the reading speed. The speed to convey sheets through the decoloring unit 18 for the images on the sheets to be erased is referred to as the decoloring speed.

Figure 3:
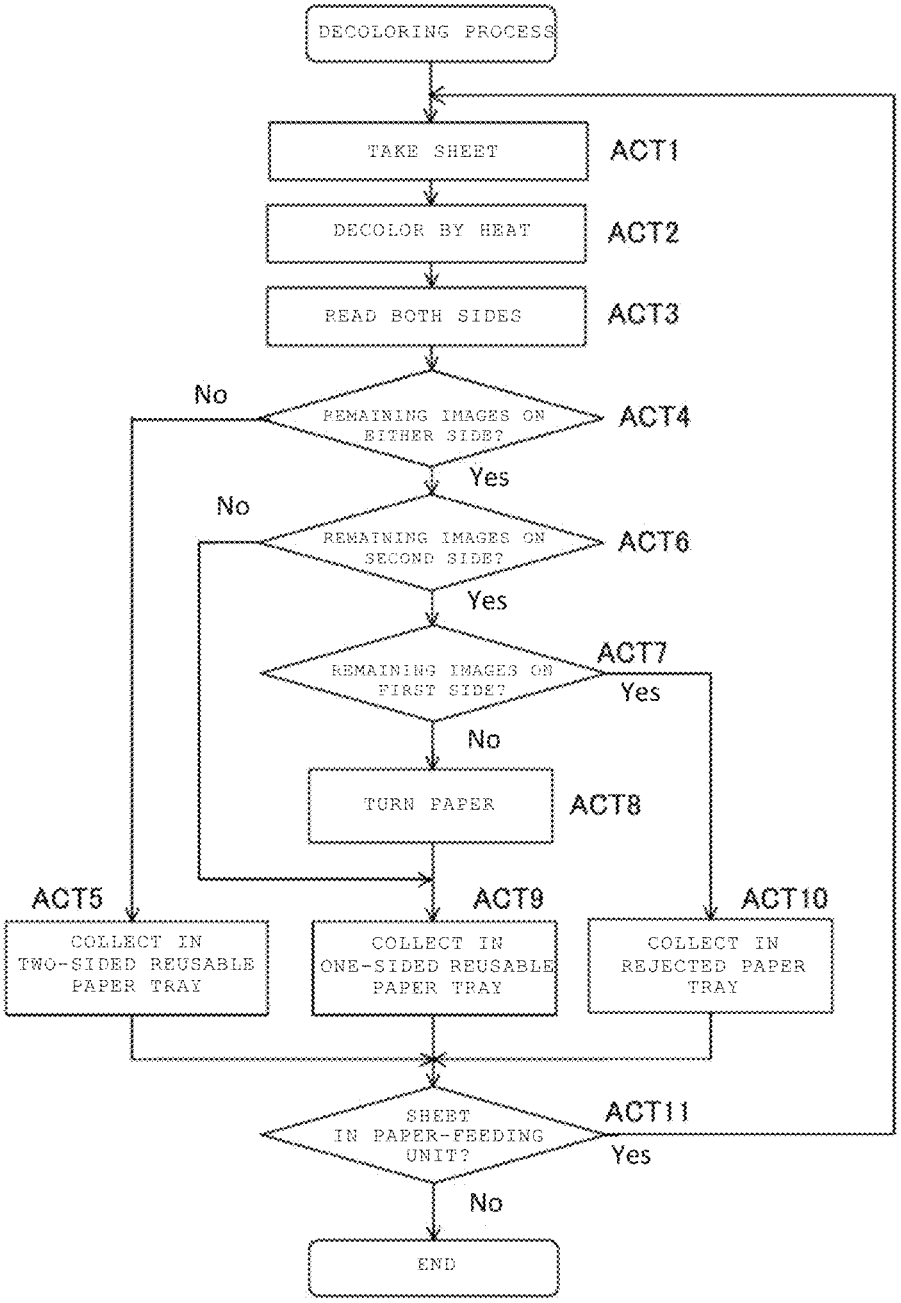
FIG. 3 is a flow chart explaining the process of the decoloring device according to the first embodiment.

FIG. 3 is the flow chart explaining the process of the decoloring device 100, according to the first embodiment.

When the decoloring process mode is selected from the control panel 47, and the decoloring process begins, the control unit 50 controls operation of the various units so that one sheet from the paper-feeding tray 12 is conveyed to the first conveying path 31 (ACT1).

The control unit 50 controls turning the first flapper 41 counterclockwise, conveyance of the sheet to the second conveying path 32, and erasure of the images on the sheet with heat by the decoloring unit 18 (ACT2).

The control unit 50 controls conveyance of the sheets that have passed through the decoloring unit 18 to the reading unit 16 and controls reading the image information on the sheets (ACT3).

The control unit 50 determines whether any image information remains on either side of the sheets that have been read by the reading unit 16 during ACT3 (ACT4).

When both sides of the sheet are determined to have no remaining image (No) at ACT4, the next step is ACTS. The control unit 50 drives the discharge roller 25 and controls conveyance of the sheet to the both-sided reusable paper tray 21 for both sides of the sheet to be reused while turning the first flapper 41 clockwise and the second flapper 42 counterclockwise.

When at least one side of the sheet is determined to have remaining images (Yes) at ACT4, the next step is ACT6, and whether the second (back) side of the sheet has any remaining images is determined.

When the second side of the sheet is determined to have no remaining image (No) at ACT6, the next step is ACT9.

The control unit 50 turns the first and second flappers 41 and 42 clockwise and the third flapper 43 counterclockwise at ACT9. Furthermore, the control unit 50 drives the discharge roller 26 and controls conveyance of the sheet to the one-sided reusable paper tray 22 for one side of the sheet to be reused.

When the second side of the sheet is determined to have remaining images (Yes) at ACT6, the next step is ACT7, and whether the first (front) side of the sheet has any remaining images is determined at ACT7.

When the first side of the sheet is determined to have no remaining image (No) at ACT7, the next step is ACT8.

The control unit 50 turns the second flapper 42 counterclockwise and conveys the sheet to the sheet-reversing unit 24 at ACT8. Furthermore, the control unit 50 turns the third flapper 43 counterclockwise while turning the discharge roller 25 backwards and controls conveyance of the sheets to the third conveying path 33.

The control unit 50 turns the fourth flapper 44 counterclockwise, drives the discharge roller 26, and controls conveyance of the sheets to the one-sided reusable paper tray 22.

When the first side of the sheet is determined to have remaining images (Yes) at ACT7, the second and fourth flappers 42 and 44 are turned clockwise. Then, the sheets are collected on the rejected paper tray 23 via the third and fourth conveying paths 33 and 34 and the discharge roller 27 (ACT10).

The control unit 50 determines whether sheets are still present on the paper-feeding tray 12 by the detection sensor S1 during the sorting process wherein the sheets stored in the paper-feeding unit 12 are sorted into the both-sided reusable paper tray 21, the one-sided reusable paper tray 22, or the rejected paper tray 23 (ACT11).

When the paper-feeding tray 12 is determined to contain sheets (Yes) at ACT11, the sorting process continues by returning to ACT1. When the paper-feeding tray 12 is determined to contain no sheet (No), the sorting process is finished.

This embodiment collects sheets, on which images have been formed in recording materials that may be erased when heated, on the paper-feeding unit 12 and determines the image condition of both sides of the sheets as to whether they are reusable on both sides, reusable on one side, or rejected after the decoloring process is performed.

In addition, when the one-side reusable sheet is available, it is possible to improve the usability of reuse by sorting the reusable sheets.

Second Embodiment

Figure 4:
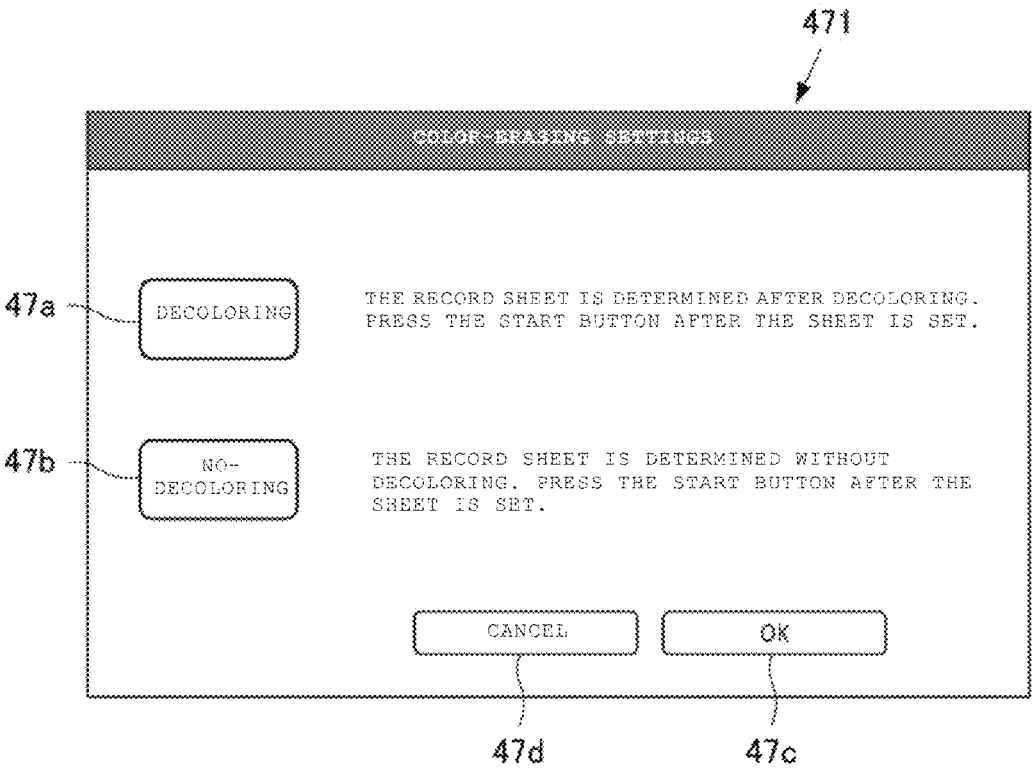
FIG. 4 is a diagram showing the decoloring device according to a second embodiment.

FIG. 4 is a diagram showing the decoloring device of the second embodiment. In this embodiment, the decoloring key 47*a,* the no-decoloring key 47*b,* the OK key 47*c,* and the cancel key 47*d* are displayed on the display unit 471, which is a touch screen, of the control panel 47, by which the displayed operations may be carried out when the decoloring process of the sheets stored in the paper-feeding unit 12 is performed.

Furthermore, the message, "The record sheets are determined after the decoloring process. Press the start button after the sheet is set" is displayed in connection with the decoloring key 47*a.* The message, "The record sheets are determined without the decoloring process. Press the start button after the sheet is set" is displayed in connection with the no-decoloring key 47*b.* In other words, the user-programmable setting screen has been created for sheets to be read, determined, and sorted without passing through the decoloring unit 18.

By allowing selection and de-selection of the decoloring function with the decoloring key 47*a* and no-decoloring key 47*b,* the decoloring device can perform the functions of reading the condition of the sheet surface by the reading unit 16, sorting the sheets, and printing (in embodiments in which the decoloring device 100 includes a printing function) without using the decoloring function.

Third Embodiment

The third embodiment of the decoloring device is explained, using FIG. 1. In this embodiment, the marking unit 55 is arranged towards the third conveying path 33 shown in FIG. 1. When images remain on one side of the sheet, the marking unit 55 marks the side to indicate that the side is not reusable. For example, the dot printer or the decoloring device 100 with a printing function uses the printing function to print "x" or "not printable" for a mark to show that the side cannot be printed on. The mark may also be done by a pen block that moves from side to side.

In this embodiment, regarding sheets that are reusable on one side, the usability of reusable sheets for the users who use reusable sheets is improved.

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein maybe made without departing from the spirit of the inventions. The accompanying claims and their equivalents are intended to cover such forms or modifications as would fall within the scope and spirit of the inventions.

What is claimed is:

1. A decoloring device comprising:

a decoloring unit configured to erase a first image formed with erasable colorant on a first side of a sheet and a second image formed with erasable colorant on a second side of the sheet;

a reading unit configured to read the first and second sides of the sheet to determine whether each of the first side and the second side is reusable;

a single-side reusable paper tray configured to receive the sheet if the reading unit determines that only one of the first and second sides is determined to be reusable; and a marking unit configured to, when only one of the first and second sides is determined to be reusable, add a mark to the one of the first and second sides that is determined to be not reusable.

2. The decoloring device according to claim 1, further comprising:

a both-side reusable paper tray configured to receive the sheet if the reading unit determines that both the first and second sides are determined to be reusable; and a rejected paper tray configured to receive the sheet if the reading unit determines that neither of the first and second sides are determined to be reusable.

3. The decoloring device according to claim 2, wherein the decoloring device is configured to convey the sheet through the reading unit and to any one of the single-side reusable paper tray, the both-side reusable paper tray and the rejected tray, without going through the decoloring unit.

4. The decoloring device according to claim 1, wherein the mark added by the marking unit is formed with non-erasable colorant.

5. The decoloring device according to the claim 1, wherein the decoloring unit erases an image formed on a sheet by heating the sheet.

6. The decoloring device according to claim 1, further comprising a control unit configured to control operations of the decoloring unit, the reading unit, and the marking unit.

7. The decoloring device according to claim 1, wherein the marking unit is a pen block that makes the mark.

8. A method for sorting sheets comprising:

reading a first side and a second side of a sheet;

determining whether one or both of the first side and the second side are reusable;

when only one of the first and second sides is determined to be reusable, adding a mark to a side of the sheet determined to be not reusable; and discharging the sheet to one of a single-side reusable paper tray, a both-side reusable paper tray, and a rejected paper tray based on the determination.

9. The method according to claim 8, wherein if neither of the first and second sides are determined to be reusable, the sheet is discharged to the rejected paper tray.

10. The method according to claim 8, further comprising:

before determining whether one or both of the first side and the second side are reusable, erasing at least one of a first image formed with erasable colorant on the first side and a second image formed with erasable colorant on the second side.

11. The method according to claim 10, further comprising:

before erasing, accepting an input from a user indicating that erasing processing is to be performed.

12. The method according to claim 10, wherein the erasing comprises heating at least one of the first side and the second side to a predetermined temperature.

13. The method according to claim 8, wherein the mark is formed with non-erasable colorant.

14. The method according to claim 13, wherein the mark is formed with a pen block.

15. A method for sorting sheets comprising:

reading a first side and a second side of a sheet;

determining that only one of the first side and the second side is reusable;

adding a mark to a side of the sheet determined to be not reusable; and discharging the sheet to a single-side reusable paper tray so that the sheet is stacked on the single-side reusable paper tray with the one of the first and second sides determined to be reusable being oriented in a predetermined orientation.

16. The method according to claim 15, further comprising:

before determining that only one of the first side and the second side is reusable, erasing at least one of a first image formed with erasable colorant on the first side and a second image formed with erasable colorant on the second side.

17. The method according to claim 16, further comprising:

before erasing, accepting an input from a user indicating that erasing processing is to be performed.

18. The method according to claim 16, wherein the erasing comprises heating at least one of the first side and the second side to a predetermined temperature.

19. The method according to claim 15, wherein the mark is formed with non-erasable colorant.

20. The method according to claim 19, wherein the mark is formed with a pen block.

* * * * *